US008582792B2

(12) United States Patent
Chao et al.

(10) Patent No.: US 8,582,792 B2
(45) Date of Patent: Nov. 12, 2013

(54) METHOD AND HEARING AID FOR ENHANCING THE ACCURACY OF SOUNDS HEARD BY A HEARING-IMPAIRED LISTENER

(75) Inventors: Kuan-Li Chao, Taipei (TW); Neo Bob Chih Yung Yang, Taipei (TW); Kuo-Ping Yang, Taipei (TW)

(73) Assignee: Kuo-Ping Yang, Taipei (TW)

( * ) Notice: Subject to any disclaimer, the term of this patent is extended or adjusted under 35 U.S.C. 154(b) by 159 days.

(21) Appl. No.: 13/064,645

(22) Filed: Apr. 6, 2011

(65) Prior Publication Data

US 2012/0140964 A1 Jun. 7, 2012

(30) Foreign Application Priority Data

Dec. 1, 2010 (TW) ..... 99141772 A

(51) Int. Cl.
*H04R 25/00* (2006.01)

(52) U.S. Cl.
USPC ..... 381/316; 381/312

(58) Field of Classification Search
USPC ..... 381/312, 316
See application file for complete search history.

(56) References Cited

U.S. PATENT DOCUMENTS

2007/0127748 A1* 6/2007 Carlile et al. ..... 381/312

OTHER PUBLICATIONS

Langendijk et al., J. Acoust. Soc. Am. vol. 112, Issue 4, pp. 1583-1596 (2002).*

* cited by examiner

*Primary Examiner* — Duc Nguyen
*Assistant Examiner* — Matthew Eason
(74) *Attorney, Agent, or Firm* — Bacon & Thomas, PLLC

(57) ABSTRACT

A method for enhancing the accuracy of sounds heard by a hearing-impaired listener is disclosed. The method for enhancing the accuracy of sounds heard by a hearing-impaired listener includes receiving an input sound, determining if it is necessary to modify the frequency of the input sound, and modifying the input sound into a modified input sound if necessary. The determination relies on the frequency and energy of the input sound. The ratio of the energy of lower frequencies of the modified input sound will be increased.

10 Claims, 11 Drawing Sheets

METHOD AND HEARING AID FOR ENHANCING THE ACCURACY OF SOUNDS HEARD BY A HEARING-IMPAIRED LISTENER

BACKGROUND OF THE INVENTION

1. Field of the Invention

The present invention relates to a method and hearing aid for enhancing the accuracy of sounds heard by a hearing-impaired listener; more particularly, the present invention relates to a method and hearing aid for enhancing the accuracy of sounds heard by a hearing-impaired listener by means of modifying the frequency of an input sound.

2. Description of the Related Art

Hearing aids have existed for decades. The main concept of the hearing aid is to amplify the sound so as to help a hearing-impaired listener to hear the previously-unheard sound. As a result, the hearing-impaired listener can hear the voice of a speaker without the need for the speaker to intentionally speak louder. However, hearing aids do not allow the hearing impaired listener to hear all sounds. Types of sounds that hearing-impaired listeners cannot hear have two characteristics: the frequency is too high, and the intensity is too low. Sounds with these two characteristics are often undetected by the hearing-impaired listener. For example, because the Mandarin consonants "ㄗ", "ㄘ" and "ㄙ" have such characteristics, the hearing-impaired listener has trouble hearing these syllables. However, most conventional hearing aids, which are used only for enhancing the energy of the overall sound without identifying individual phonemes that need to be enhanced, may distort the sounds during amplification. Related known prior arts regarding improving the sound by processing the frequency are briefly described hereinafter:

U.S. Pat. No. 7,305,100 discloses a "dynamic compression in a hearing aid" mainly used for minimizing sound delay.

U.S. Pat. No. 4,454,609 discloses a "speech intelligibility enhancement" used for enhancing the consonant sounds of speech with high frequencies. The greater the high-frequency content relative to the low, the more the high-frequency content is boosted. In this known prior art, high-frequency consonant sounds are enhanced. However, it is very difficult to detect the occurrence of consonants in daily conversations. Therefore, this known prior art is not applicable to a hearing aid.

U.S. Pat. No. 4,759,071 discloses an "automatic noise eliminator for hearing aids" mainly used for noise elimination. It removes all sounds below a predetermined level and transmits a compressed sound range for all sounds above a predetermined level. The object of this known prior art is different from that of the present invention. Further, it may cause sound distortion by removing all sounds below the predetermined level.

U.S. Pat. No. 6,577,739 discloses an "apparatus and methods for proportional audio compression and frequency shifting", which provides an understandable audio signal to listeners who have hearing loss in particular frequency ranges by proportionally compressing the audio signal. However, this known prior art compresses all audio signals, which may result in serious sound distortion.

U.S. Pat. No. 7,609,841 (hereinafter as "the '841 patent") discloses a "frequency shifter for use in adaptive feedback cancellers for hearing aids", which improves a conventional frequency shifting method by means of applying frequency shifting only to the high frequency portion of the signal (which is shifted alternately upward and/or downward), wherein the frequency shifting ratio is less than 6%. Although the '841 patent also applies frequency shifting to high frequency signals, its frequency shifting intensity and frequency shifting direction are different from those of the present invention.

U.S. Pat. No. 7,580,536 (hereinafter "the '536 patent") discloses a "sound enhancement for hearing-impaired listeners", which provides a method of enhancing the sound heard by a hearing-impaired listener. The '536 patent compresses high frequency sounds with energy greater than a predetermined threshold or shifts the high frequency sounds to a lower frequency range without altering low frequency sounds (such as normal human speaking frequencies). According to the embodiment of the '536 patent, the processed high frequency sounds are at 32 kHz (column 6, line 18), which is not a normal human speaking frequency. Further, the specification of the '536 patent does not disclose the value of the "predetermined threshold".

Therefore, there is a need to provide a method and hearing aid for enhancing the accuracy of sounds heard by a hearing-impaired listener capable of identifying the sound that needs to be enhanced so as to modify the frequency accordingly, thereby mitigating and/or obviating the aforementioned problems.

SUMMARY OF THE INVENTION

It is an object of the present invention to provide a method for enhancing the accuracy of sounds heard by a hearing-impaired listener.

It is another object of the present invention to provide a hearing aid for enhancing the accuracy of sounds heard by a hearing-impaired listener.

To achieve the abovementioned objects, the method for enhancing the accuracy of sounds heard by a hearing-impaired listener of the present invention comprises the following steps. First, the method receives an input sound. Second, the method determines if it is necessary to modify the frequency of the input sound. The input sound necessary for frequency modification is characterized in that: the proportion of the sound energy below 1000 Hz of the input sound to all sound energy of the input sound is between 0% and 25%; and the proportion of the sound energy below 6000 Hz of the input sound to all sound energy of the input sound is A %, wherein A is a value between 0 and 80. Finally, if the input sound is determined to need frequency modification in the second step, the method modifies the input sound into a modified input sound. The modified input sound comprises a plurality of sounds at different frequencies, and the modified input sound is characterized in that: the proportion of the sound energy below 6000 Hz of the modified input sound to all sound energy of the modified input sound is B %, wherein B is 1.15 to 10,000 times of A.

The hearing aid for enhancing the accuracy of sounds heard by a hearing-impaired listener of the present invention comprises three main components: a sound receiver, a sound processing module, and a speaker. The sound receiver is used for receiving the input sound. The sound processing module is used for determining if it is necessary to modify the frequency of the input sound so as to provide a modified input sound. The input sound necessary for frequency modification is characterized in that: the proportion of the sound energy below 1000 Hz of the input sound to all sound energy of the input sound is between 0% and 25%; and the proportion of the sound energy below 6000 Hz of the input sound to all sound energy of the input sound is A %, wherein A is a value between 0 and 80. Further, the modified input sound is characterized in that: the proportion of the sound energy below 6000 Hz of the modified input sound to all sound energy of the modified input sound is B %, wherein B is 1.15 to 10,000 times of A. Finally, the speaker is connected to the sound processing module and is used for outputting the input sound or the modified input sound.

Other objects, advantages, and novel features of the invention will become more apparent from the following detailed description when taken in conjunction with the accompanying drawings.

BRIEF DESCRIPTION OF THE DRAWINGS

These and other objects and advantages of the present invention will become apparent from the following description of the accompanying drawings, which disclose several embodiments of the present invention. It is to be understood that the drawings are to be used for purposes of illustration only, and not as a definition of the invention.

In the drawings, wherein similar reference numerals denote similar elements throughout the several views.

DETAILED DESCRIPTION OF THE PREFERRED EMBODIMENT

Figure 1:
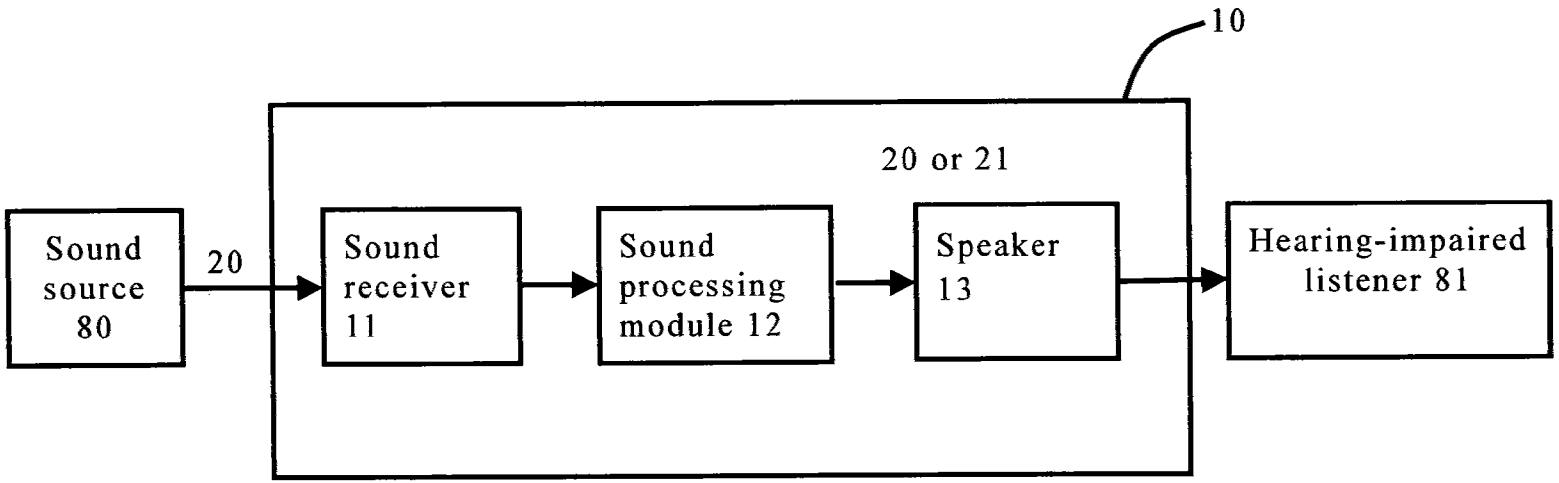
FIG. 1 illustrates a structural drawing of a hearing aid according to the present invention.

Please refer to FIG. 1, which illustrates a structural drawing of a hearing aid according to the present invention.

The hearing aid 10 of the present invention comprises a sound receiver 11, a sound processing module 12, and a speaker 13. The sound receiver 11 is used for receiving an input sound 20 from a sound source 80. The input sound 20 is processed by the sound processing module 12 for being outputted through the speaker 13. The sound receiver 11 can be a microphone or any other equivalent sound receiving equipment without being limited to the above scope. The speaker 13 can be a headphone or any other equivalent outputting equipment without being limited to the above scope. The sound processing module 12 is generally composed of a sound effect processing chip associated with a control circuit and an amplification circuit, or can be composed of a solution including a processor and a memory associated with a control circuit and an amplification circuit. The purpose of the sound processing module 12 is to perform amplification of sound signals, to filter out noises, to change the sound frequency composition, and to perform necessary processes according to the object of the present invention. Because the sound processing module 12 can be implemented by utilizing conventional hardware associated with new firmware or software, there is no need for further description of the hardware structure of the sound processing module 12. Generally, the hearing aid 10 of the present invention can be a hardware specialized dedicated device, or can be, but is not limited to, a small computer such as a personal digital assistant (PDA), a PDA phone, a smart phone, and/or a personal computer.

Figure 2:
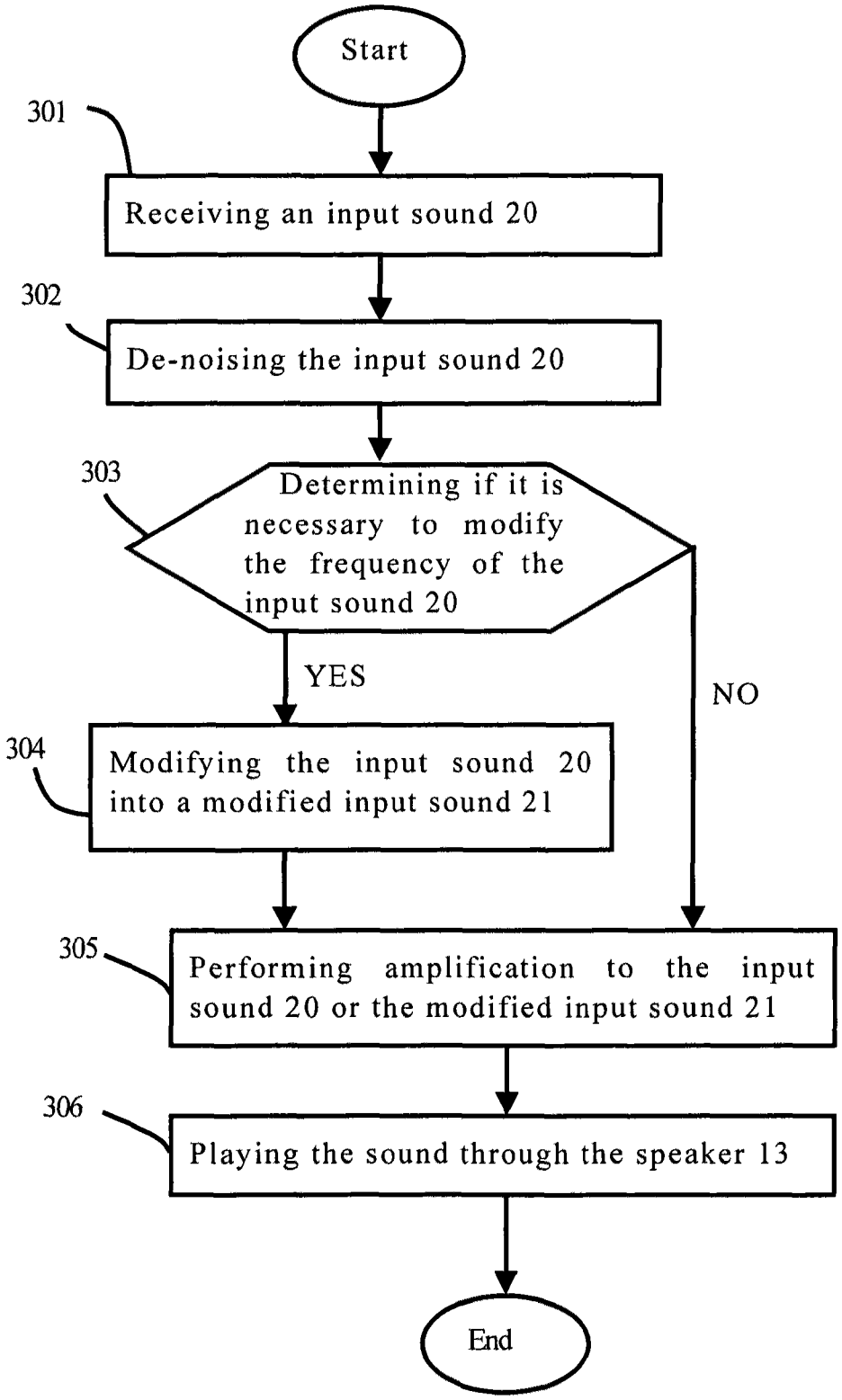
FIG. 2 illustrates a flowchart of a sound processing module according to the present invention.

Please refer to FIG. 2, which illustrates a flowchart of a sound processing module according to the present invention. Please also refer to FIGS. 3 to 7 according to the related embodiments of the present invention.

Step 301: receiving an input sound 20.

This step is accomplished by the sound receiver 11, which receives the input sound 20 from the sound source 80.

Step 302: de-noising the input sound 20.

After the sound receiver 11 receives the input sound 20, the sound processing module 12 performs a de-noising process first. Because the de-noising process is a known technique, there is no need for further description.

Step 303: determining if it is necessary to modify the frequency of the input sound 20.

Figure 3:
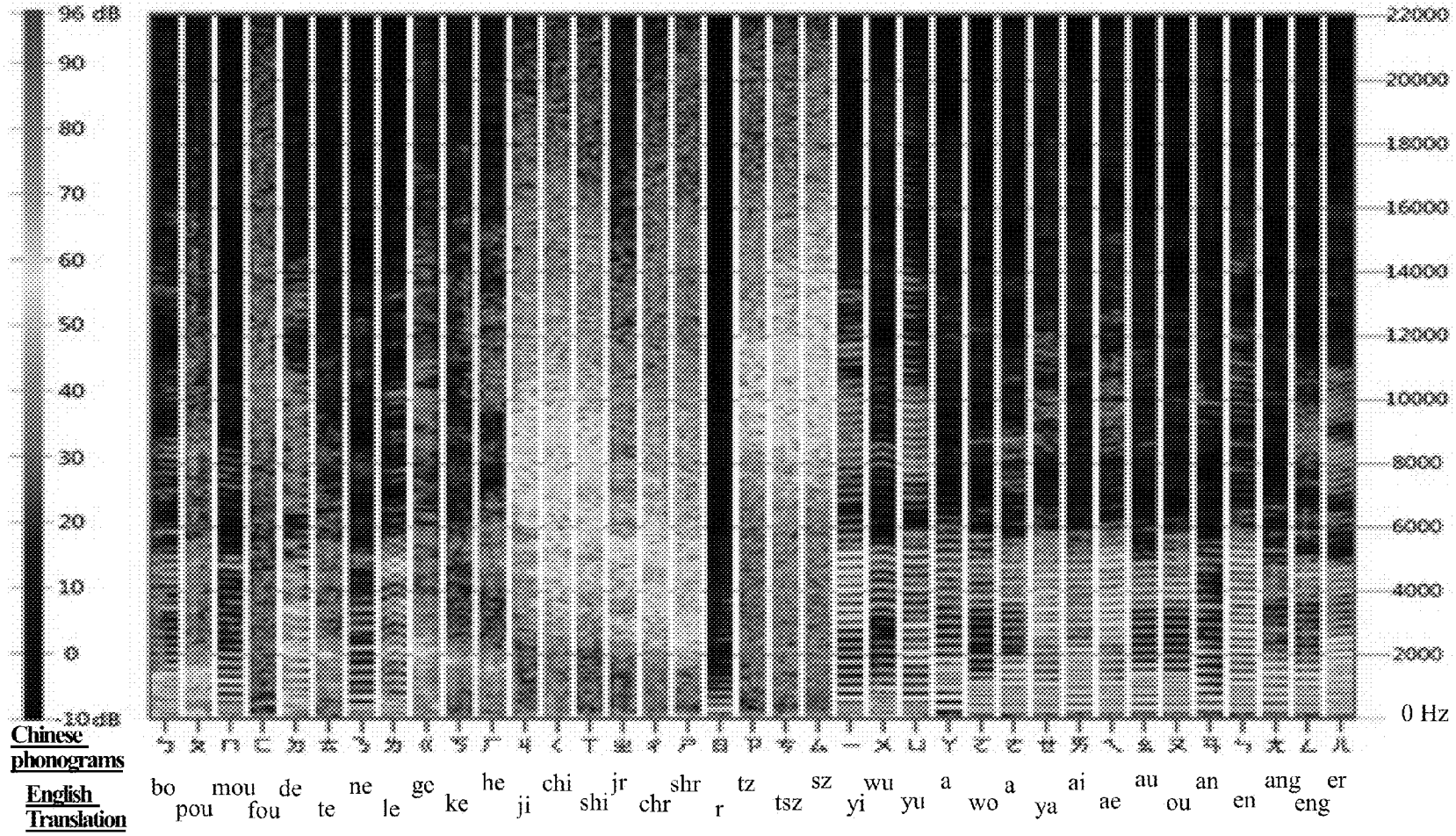
FIG. 3 illustrates a Mandarin phoneme energy/frequency distribution diagram according to the present invention.

The key point of the present invention is that the sound processing module 12 performs step 303. The sound processing module 12 determines if it is necessary to modify the frequency of the input sound 20 according to preset conditions. Firstly, please refer to FIG. 3, which illustrates a Mandarin phoneme energy/frequency distribution diagram according to the present invention. FIG. 3 is generated in a graphic form according to research data compiled upon development of the present invention. The relationship between the pronunciation energy and frequency have rarely been studied in the past. In FIG. 3, the horizontal axis represents 37 Mandarin phonemes, the left vertical axis represents the frequency (Hz), and the right vertical axis represents the volume (dB). According to FIG. 3, the pronunciation of all sounds covers multiple frequencies, including low, medium, and high frequencies, wherein the pronunciation energies of most Mandarin phonemes are distributed in a low frequency range of 20~1000 Hz. However, the energies of some Mandarin phonemes, such as "ㄗ", "ㄘ" or "ㄙ", whose proportion of the sound energy within the low frequency range is comparatively low, are mostly distributed in the medium/high frequency portion. Generally, it is very difficult for a hearing-impaired listener to sense/notice high-frequency sounds (such as above 6000 Hz). That is, the high-frequency sounds in the phonemes "ㄗ", "ㄘ" or "ㄙ" need to be outputted at a louder volume as compared to the low-frequency sounds such that the hearing-impaired listener can have a better chance of hearing them. However, if the overall sound is outputted at a louder volume, the low frequency sounds will be too loud to the hearing-impaired listener. Therefore, the method of amplifying the sound as a whole cannot solve this practical problem. Moreover, even if a filtering technique is applied to enhance the high-frequency energy only, it might still result in the problem that the hearing-impaired listener hears nothing, even when the energy has exceeded the pain threshold of the hearing-impaired listener.

In some known prior art techniques, such as U.S. Pat. No. 6,577,739, the frequencies of all sounds are lowered first, and then the sound energies are amplified before being outputted to the hearing-impaired listener. However, although such a technique can help the hearing-impaired listener to hear the sounds which were originally at high frequency, the sounds are seriously distorted because all sound frequencies are lowered (including those sounds which could be heard originally), which makes it very difficult for the hearing-impaired listener to learn correct pronunciation.

The object of the method of enhancing the accuracy of sounds heard by a hearing-impaired listener of the present invention is to modify the input sound 20 into a modified input sound 21 (step 304) by means of lowering the frequency of the sound segment with more high-frequency energy; otherwise, no frequency modification is applied to the input sound 20.

The input sound 20 necessary for frequency modification is characterized in that:

If the digital signal sampling rate of a sound is 4410 Hz, the proportion ($\rho_{0m}$) of the sound energy below 1000 Hz of the input sound 20 to all sound energy of the input sound 20 is between 0% and 25%; and the proportion ($\rho_{1m}$) of the sound energy below 6000 Hz of the input sound 20 to all sound energy of the input sound is A %, wherein A is a value between 0 and 80. If the input sound 20 meets these two criteria, the input sound 20 is distributed in the high frequency portion and is not easily heard by the hearing-impaired listener. Therefore, frequency modification is necessary.

In step 303, the determination can be accomplished in practice in many ways. In order to rapidly (such as within 0.01 second) determine if it is necessary to perform step 304, the method determines the energy of the frequency every 1024 Hz and then utilizes fuzzy logic to determine if the input sound 20 meets the above two conditions. There are many mathematical approaches for such a determination. Because the object of the present invention is not to improve the mathematical calculation models, there is no need for further description. Please note that the thresholds in the determination of step 303 can also vary. The above two conditions are conservative thresholds after experimental calculation. If stricter thresholds are required, the above two conditions are suggested as follows:

The proportion ($\rho_{0m}$) of the sound energy below 1000 Hz of the input sound 20 to all sound energy of the input sound 20 is between 0% and 20%; and the proportion ($\rho_{1m}$) of the sound energy below 6000 Hz of the input sound 20 to all sound energy of the input sound is A %, wherein A is a value between 0 and 70.

Figure 4:
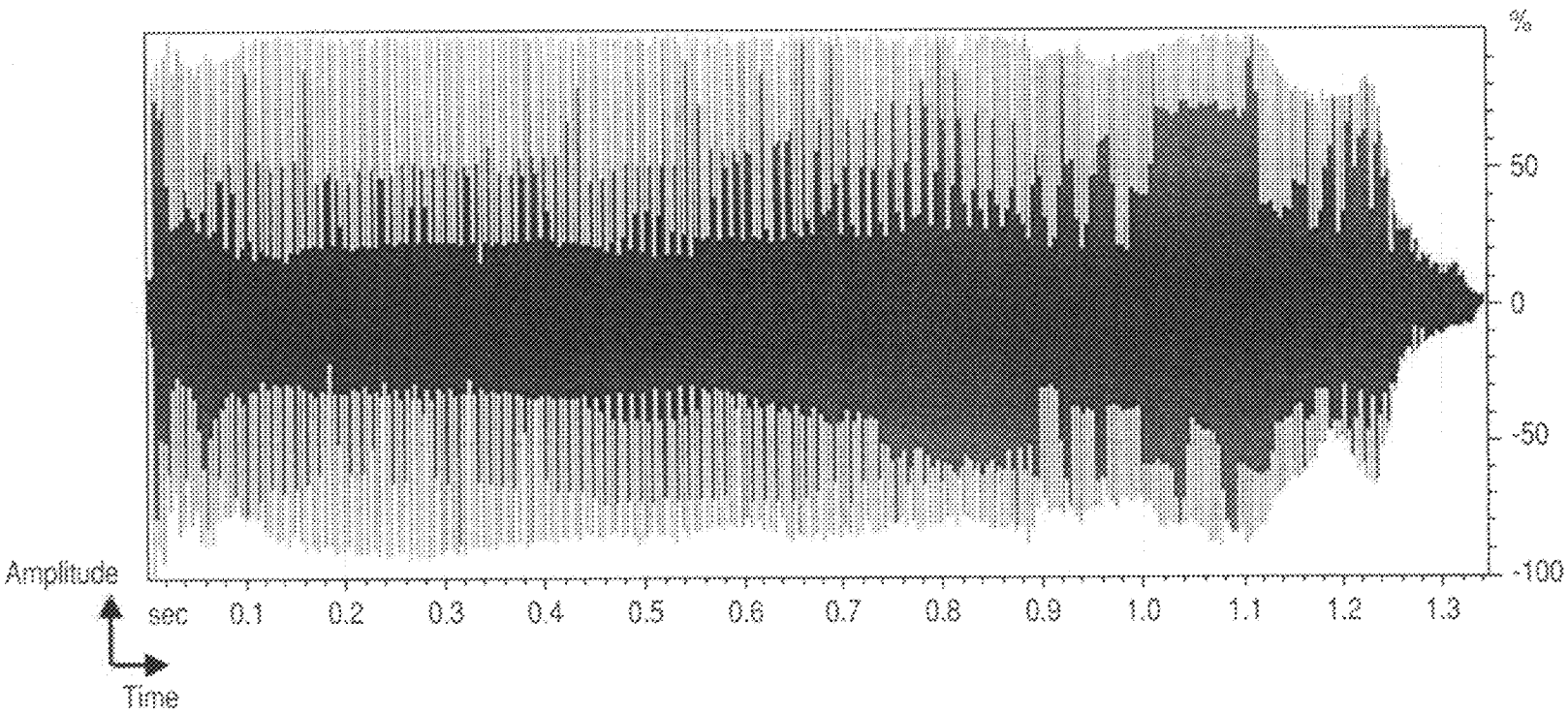
FIG. 4 illustrates a sound spectrogram of a Mandarin syllable "ㄅㄚ" according to the present invention.
Figure 5:
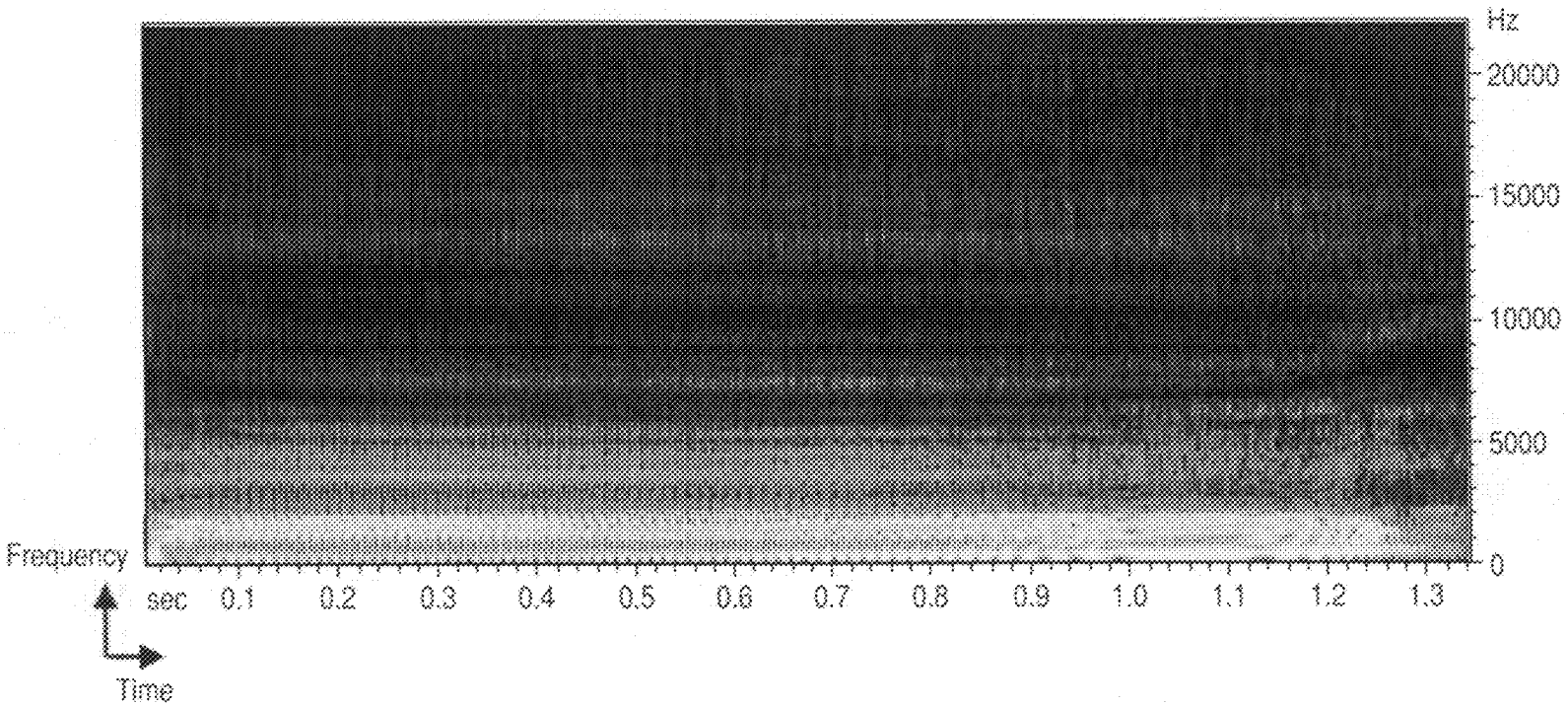
FIG. 5 illustrates a sound energy diagram of the Mandarin syllable "ㄅㄚ" according to the present invention.

Next, please refer to FIG. 4 and FIG. 5. FIG. 4 illustrates a sound spectrogram (with the horizontal axis as time and the vertical axis as amplitude) of a Mandarin syllable "ㄅㄚ" according to the present invention; FIG. 5 illustrates a sound energy diagram (with the horizontal axis as time, the vertical axis as frequency, and the sound energy expressed in gray levels decreasing from top to bottom, wherein the darker tones refer to higher energy and lighter tones refer to lower energy) of the Mandarin syllable "ㄅㄚ" according to the present invention. As shown in FIG. 5, the energy is distributed within the range of 1000~2000 Hz. After calculation, $\rho_{0m}$ is 12.2%, which is less than 25%, but $\rho_{1m}$ (i.e. A) is close to 100, which is not within the range of 0~80. Therefore, no frequency modification is applied to "ㄅㄚ".

Figure 6:
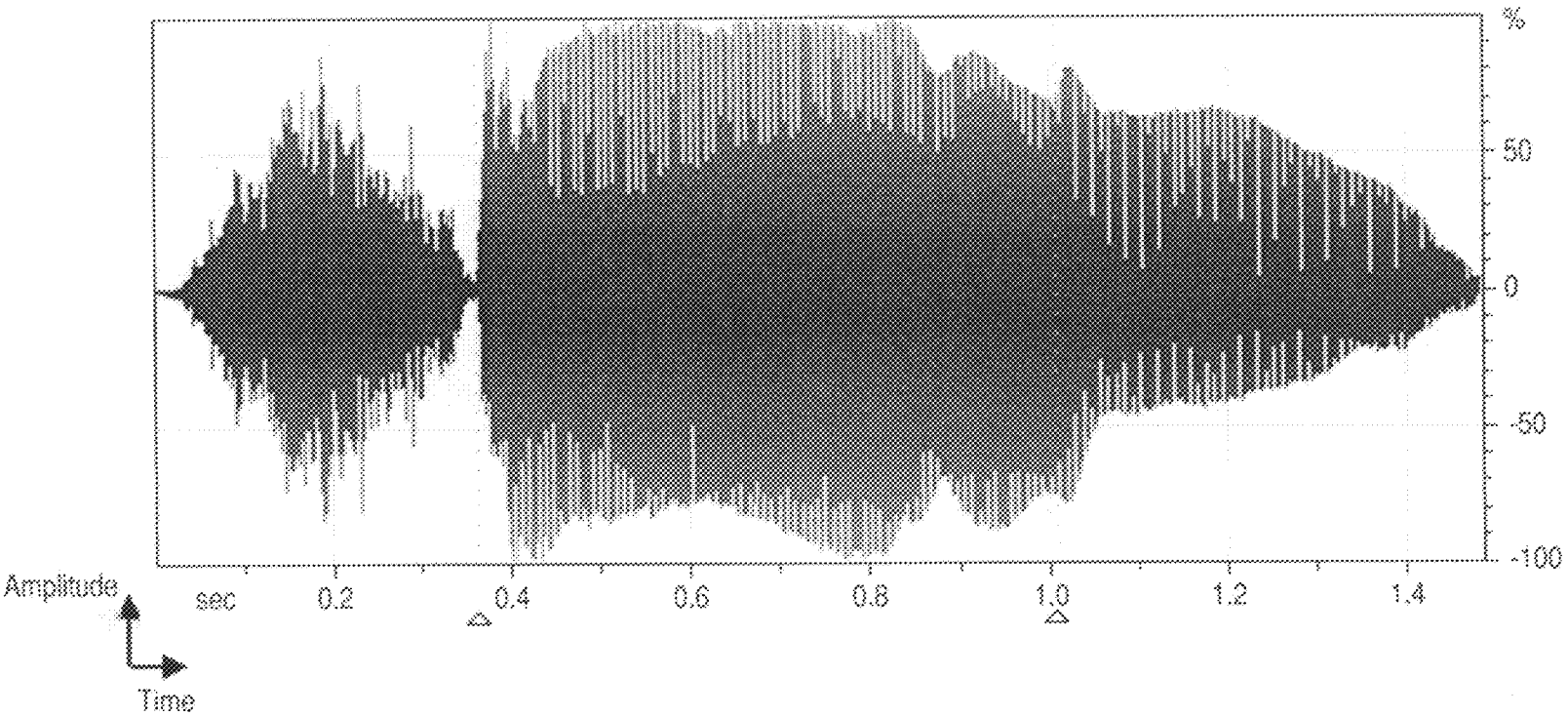
FIG. 6 illustrates a sound spectrogram of a Mandarin syllable "ㄙㄠ" according to the present invention.
Figure 7:
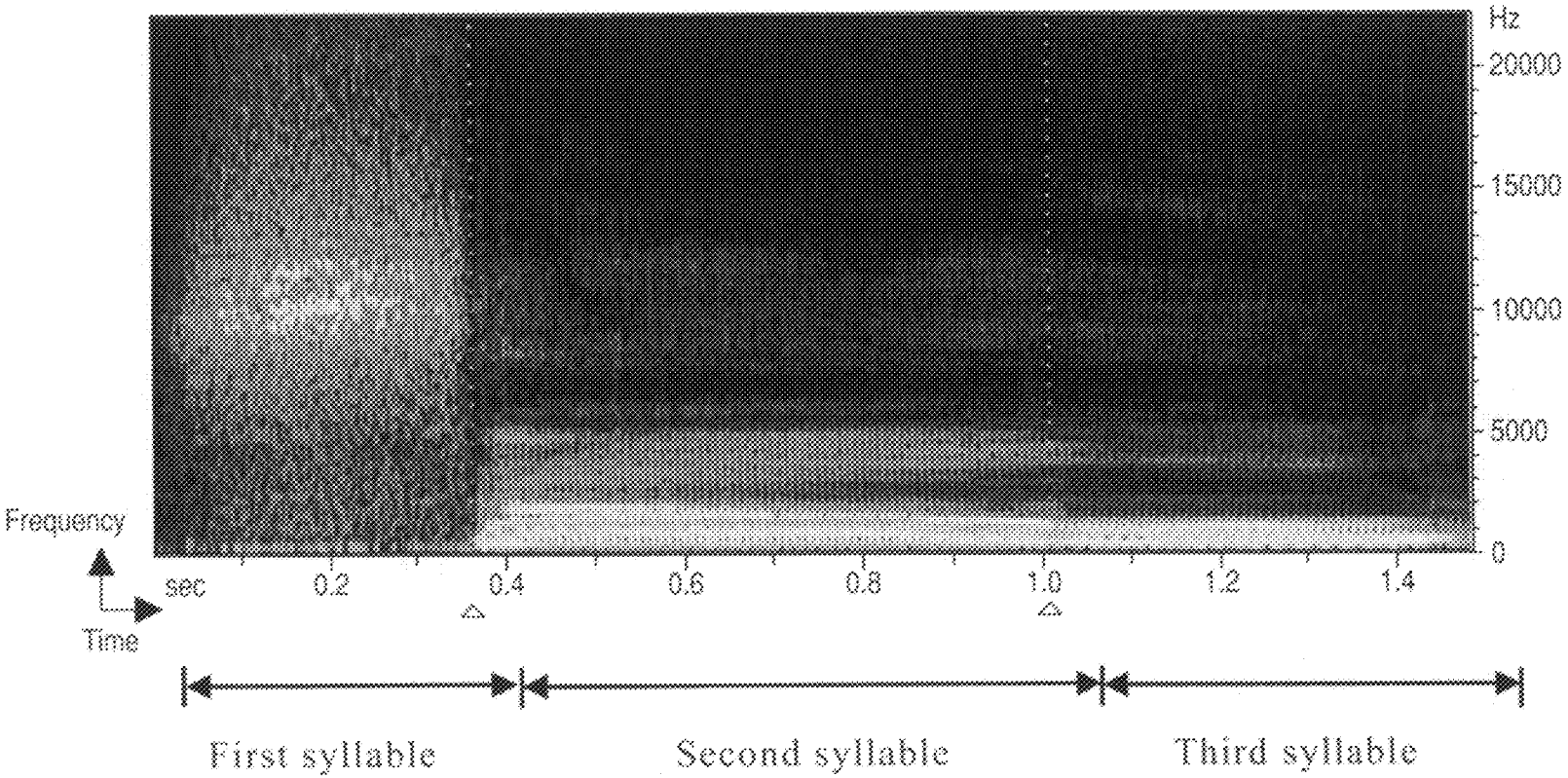
FIG. 7 illustrates a sound energy diagram of the Mandarin syllable "ㄙㄠ" according to the present invention.

Please refer to FIG. 6 and FIG. 7. FIG. 6 illustrates a sound spectrogram of a Mandarin syllable "ㄙㄠ" according to the present invention; FIG. 7 illustrates a sound energy diagram of the Mandarin syllable "ㄙㄠ" according to the present invention. As shown in FIG. 7, this syllable can be divided into three phonemes. The first phoneme refers to "ㄙ", wherein its $\rho_{0m}$ is 0.2%, which is less than 25%, and its $\rho_{1m}$ (i.e. A) is 0.4%. This means most of the energy is distributed above 6000 Hz. Therefore, the phoneme "ㄙ" is very difficult for the hearing-impaired listener to hear, and its frequency requires modification. In contrast, the $\rho_{0m}$ of the second phoneme is 16.3%, which is less than 25%, and its $\rho_{1m}$ is close to 100%; the $\rho_{0m}$ of the third phoneme is 99.9%, which is greater than 25%. Therefore, it is not necessary to modify the frequencies of the second phoneme and the third phoneme.

Step 304: modifying the input sound 20 into a modified input sound 21.

In step 303, if the input sound 20 is determined necessary for frequency modification, step 304 modifies the input sound 20 into a modified input sound 21. The modified input sound 21 is characterized in that: the proportion of the sound energy below 6000 Hz of the modified input sound 21 to all sound energy of the modified input sound 21 is B %, wherein B is 1.15 to 10,000 times of A. For a better result, preferably B is 1.3 to 10000 times of A. Accordingly, the energy proportion of the medium/high frequency portion in the modified input sound 21 is lowered, and as compared to the original input sound 20, the modified input sound 21 is easier for the hearing-impaired listener to sense.

There are many approaches for frequency modification, of which frequency compression and frequency shifting are commonly applied. The implementation of frequency compression is to compress the sound within a specific frequency range into a narrower frequency range. For example, a sound originally within the range of 0~6000 Hz is compressed into the range of 0~3000 Hz, and a sound originally at 3000 Hz is compressed to 1500 Hz. The implementation of frequency shifting is to shift the sound within a specific frequency range into another frequency range. For example, a sound originally within the range of 3000~9000 Hz is shifted into the range of 0~6000 Hz by means of downwardly shifting the sound by 3000 Hz. Frequency compression and frequency shifting are known prior arts; therefore, there is no need for further description. Please note that the frequency modification applications of the present invention are not limited to the above description. Other equivalent applications can also be applied as long as similar results can be achieved.

Figure 8:
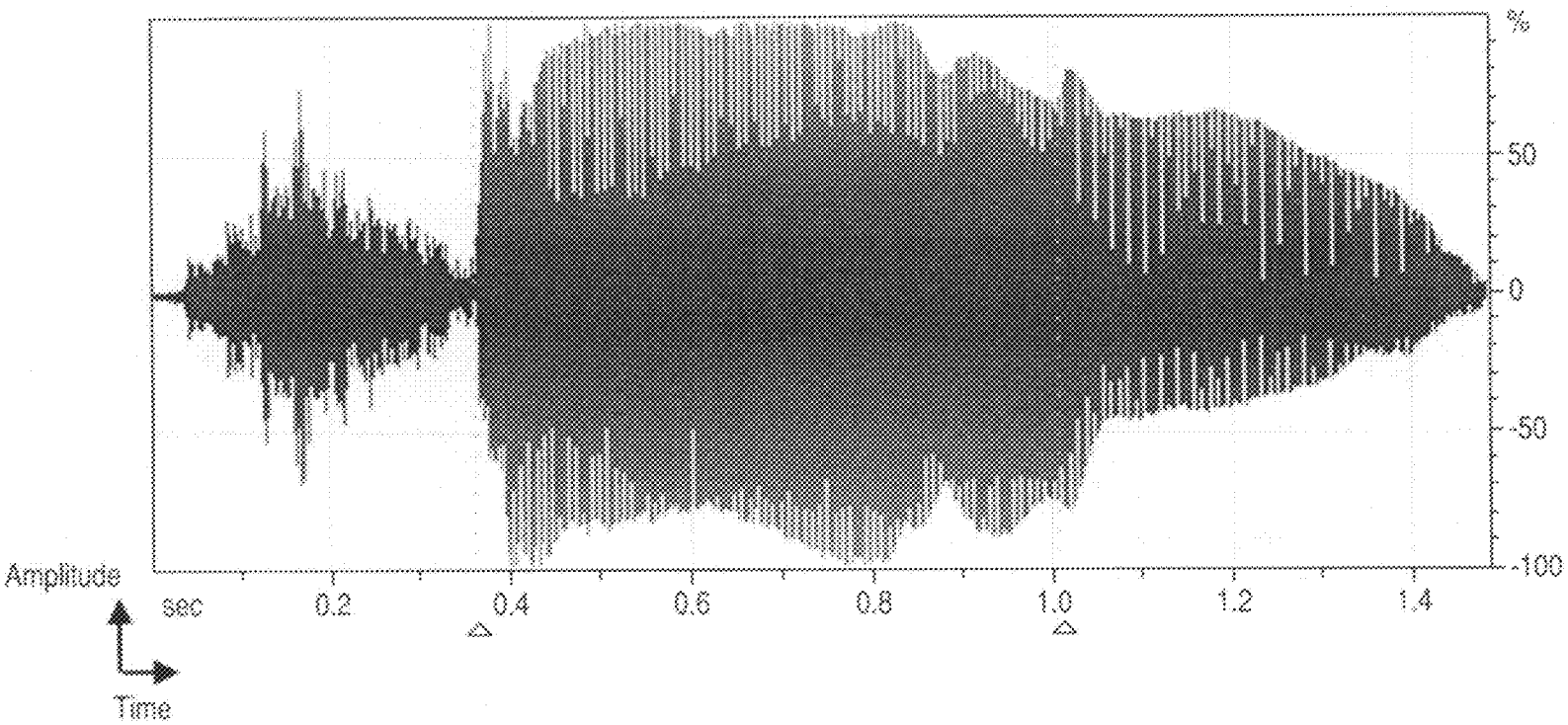
FIG. 8 illustrates a sound spectrogram of the Mandarin syllable "ㄙㄠ" according to a modified input sound "ㄙㄠ" of a first embodiment of the present invention.
Figure 9:
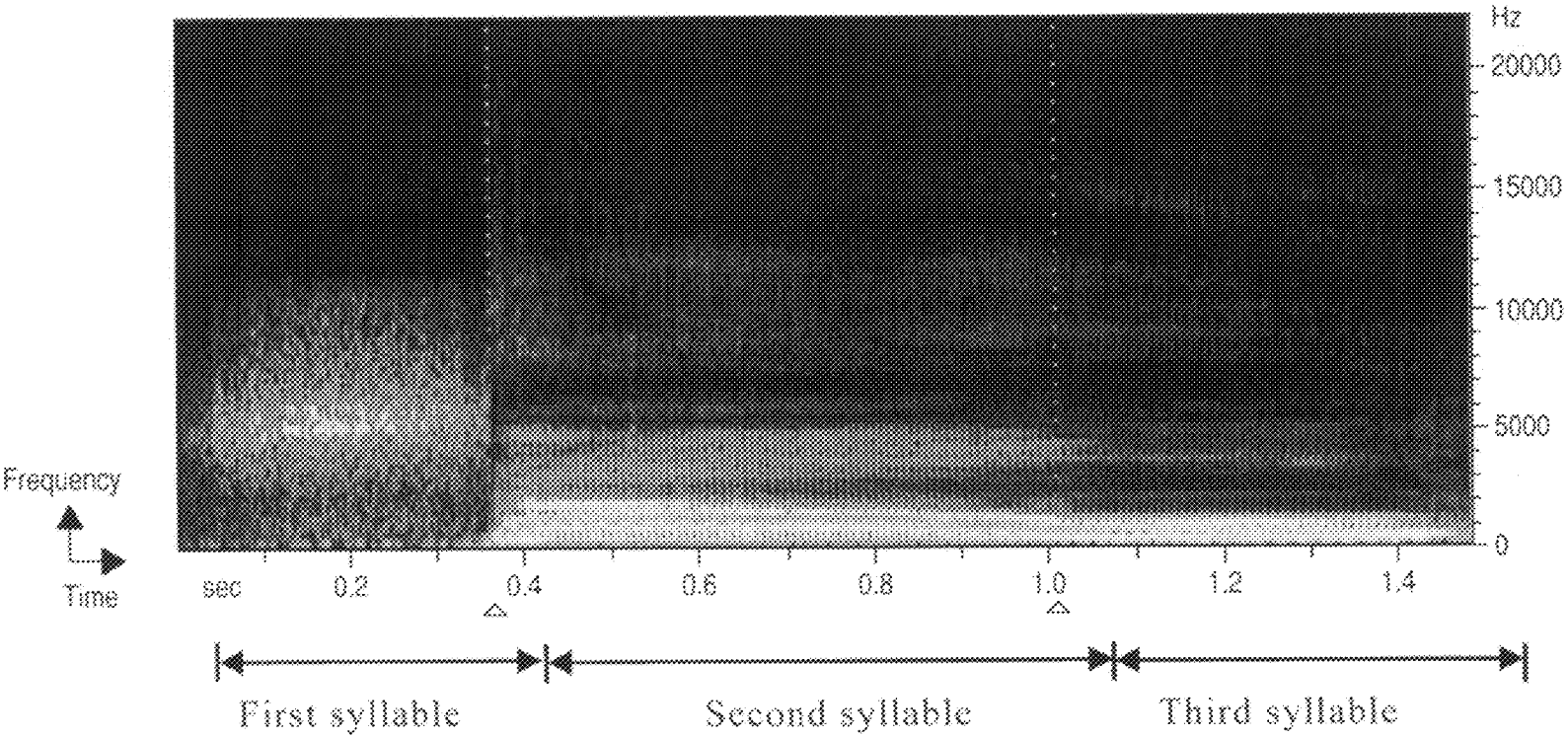
FIG. 9 illustrates a sound energy diagram of the Mandarin syllable "ㄙㄠ" according to the modified input sound "ㄙㄠ" of the first embodiment of the present invention.

If the sound source 80 outputs "ㄙㄠ" as the input sound 20, in step 303, the sound processing module 12 will determine it is necessary for frequency modification. Therefore, step 304 will perform "frequency compression" or "frequency shifting" to modify the input sound 20 into the modified input sound 21. Please refer to FIG. 8 and FIG. 9 according to a first embodiment of the present invention. As shown in the figures, after performing frequency compression to "ㄙㄠ" (from 0~22050 Hz to 0~11025 Hz), the first phoneme, "ㄙ", originally within a high frequency range, is compressed into a lower frequency range; further, the processed B is 96.1%, which is greater than 1.15 times of A (0.04%). The second phoneme and the third phoneme remain unchanged. As shown in FIG. 9, the energy at 500 Hz is enhanced.

Figure 10:
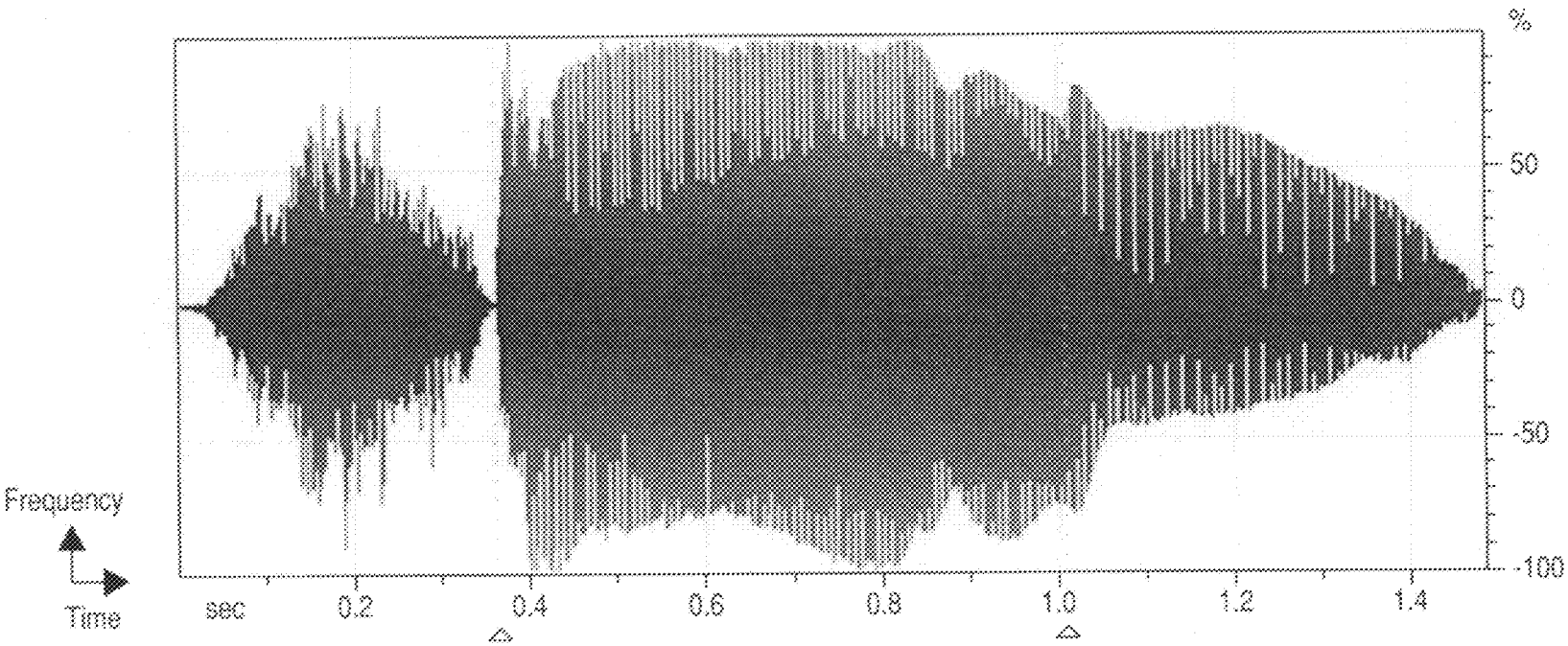
FIG. 10 illustrates a sound spectrogram of the Mandarin syllable "ㄙ ㄠ" according to a modified input sound "ㄙㄠ" of a second embodiment of the present invention.
Figure 11:
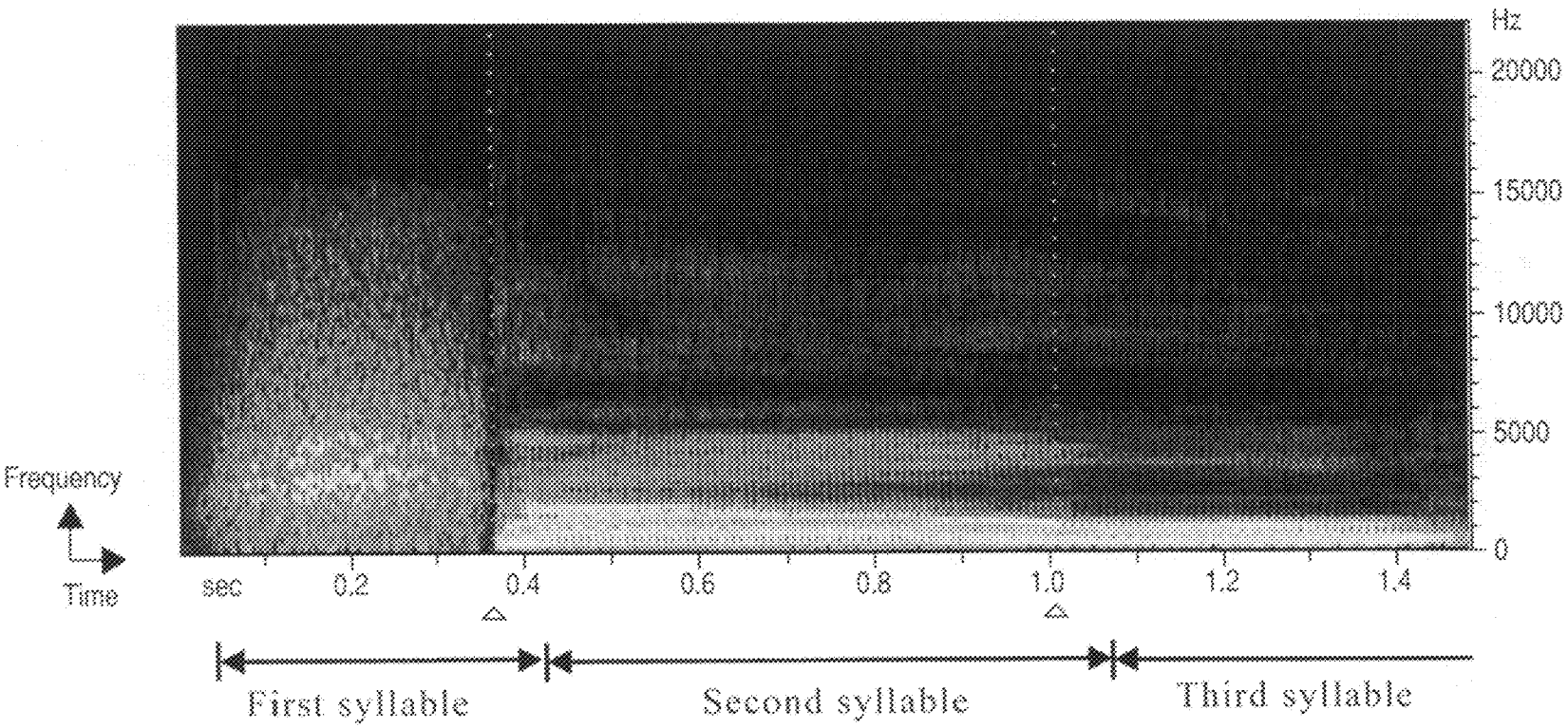
FIG. 11 illustrates a sound energy diagram of the Mandarin syllable "ㄙㄠ" according to the modified input sound "ㄙㄠ" of the second embodiment of the present invention.

Further, please refer FIG. 10 and FIG. 11 for a second embodiment of the present invention. As shown in the figures, after performing frequency shifting to "ㄙㄠ" (by downwardly shifting 7000 Hz of the frequencies above 7000 Hz), the first phoneme, "ㄙ", originally within a high frequency range, is shifted into a lower frequency range; further, the processed B is 98.3%, which is greater than 1.15 times of A (0.4%). The second phoneme and the third phoneme remain unchanged. As shown in FIG. 11, the energy at 1000 Hz is enhanced.

Step 305: performing amplification to the input sound 20 or the modified input sound 21.

Basically, the sound for being outputted to the hearing-impaired listener 81 requires amplification. But please note that sounds are not always proportionally amplified. A sound with a lower volume has a higher amplification ratio, while a sound with a higher volume has a comparatively lower amplification ratio. Therefore, generally, the sound processing module 12 comprises a sound wave amplification module, or an amplifier. Because step 305 is a known prior art, there is no need for further description.

Step 306: playing the sound through the speaker 13.

The speaker 13 plays the sound processed by the sound processing module 12.

Please note that the hearing aid 10 should be able to process the sound rapidly, such that the hearing-impaired listener 81 can hear the sound almost simultaneously. Therefore, the sound length of the input sound 20 should be as short as possible, so as to reduce the delay time. For example, the above method is performed every 0.01 second; therefore, practically, the length of each input sound 20 is 0.01 second. If the duration of "ㄙㄠ" is 1 second, the method will perform the determination 100 times (by performing one determination for every 0.01 second of sound on a first-in-first-out basis). If the duration of the first phoneme "ㄙ" is 0.1 second, and the total duration of the other phonemes is 0.9 second, the first 10 input sounds 20 will be modified into the modified input sounds 21, and the last 90 input sounds 20 will not be modified into the modified input sounds 21.

With regard to the sounds "ㄗㄠˇ ㄋ", the hearing-impaired listener wearing a conventional hearing aid may hear the output sounds as "ㄠˇ ㄋ", which explains why hearing-impaired listeners often say "ㄠˇ ㄋ" instead of "ㄗㄠˇ ㄋ". However, in the simulated experiment of the present invention, the output sounds of the sounds "ㄗㄠˇ ㄋ" heard by the hearing-impaired listener were very close to "ㄗㄠˇ ㄋ", without distortion.

The abovementioned technique can also be applied in other languages. According to experimental results, the present invention is especially beneficial to words with short syllables, such as Chinese, Japanese and Korean. In Chinese/Mandarin, for example, each Chinese/Mandarin word comprises at most three syllables. The present invention is less beneficial to multi-syllable languages such as English. However, all languages have short syllables, so a hearing-impaired listener may say the English word "Say" as "A". After experiencing the simulated experiment of the present invention, the output sound of the sound "Say" heard by the hearing-impaired listener would be very close to "Say" without distortion.

Although the present invention has been explained in relation to its preferred embodiments, it is to be understood that many other possible modifications and variations can be made without departing from the spirit and scope of the invention as hereinafter claimed.

What is claimed is:

1. A method for enhancing the accuracy of sounds heard by a hearing-impaired listener, comprising the following steps:

(A) receiving an input sound;

(A1) determining a proportion of sound energy of the input sound below 1000 Hz;

(A2) determining a proportion of sound energy of the input sound below 6000 Hz;

(B) determining if it is necessary to modify the frequency of the input sound according to two criteria, wherein a first criteria is that the proportion of the sound energy below 1000 Hz of the input sound to all sound energy of the input sound is between 0% and 25%; and a second criteria is that the proportion of the sound energy below 6000 Hz of the input sound to all sound energy of the input sound is A %, wherein A is a value between 0 and 80; and (C) modifying the input sound into a modified input sound if both of said two criteria are met, wherein the modified input sound comprises a plurality of sounds at different frequencies, and wherein the proportion of the sound energy below 6000 Hz of the modified input sound to all sound energy of the modified input sound is B %, wherein B is 1.15 to 10,000 times of A.

2. The method for enhancing the accuracy of sounds heard by a hearing-impaired listener as claimed in claim 1, wherein in step (B), the proportion of the sound energy below 1000 Hz of the input sound to all sound energy of the input sound is between 0% and 20%.

3. The method for enhancing the accuracy of sounds heard by a hearing-impaired listener as claimed in claim 2, wherein A is a value between 0 and 70.

4. The method for enhancing the accuracy of sounds heard by a hearing-impaired listener as claimed in claim 1, 2 or 3, wherein B is 1.3 to 10,000 times of A.

5. The method for enhancing the accuracy of sounds heard by a hearing-impaired listener as claimed in claim 1, 2 or 3, wherein in step (C), the input sound is modified into the modified input sound by means of frequency compression or frequency shifting.

6. A hearing aid, used for receiving an input sound and modifying the input sound so as to output a sound to a hearing-impaired listener, the hearing aid comprising:

a sound receiver, used for receiving the input sound;

a sound processing module, electrically connected to the sound receiver, used for determining if it is necessary to modify the frequency of the input sound, so as to provide a modified input sound, wherein the sound processing module is configured to make a determination whether it is necessary to modify the frequency of the input sound according to two criteria, a first criteria being that the proportion of the sound energy below 1000 Hz of the input sound to all sound energy of the input sound is between 0% and 25%; and a second criteria being that the proportion of the sound energy below 6000 Hz of the input sound to all sound energy of the input sound is A %, wherein A is a value between 0 and 80; and wherein the sound processing module is configured to, when said first and second criteria are met, modify the input sound such that the proportion of the sound energy below 6000 Hz of the modified input sound to all sound energy of the modified input sound is B %, wherein B is 1.15 to 10,000 times of A;

and a speaker, electrically connected to the sound processing module.

7. The hearing aid as claimed in claim 6, wherein the input sound necessary for frequency modification is characterized in that:

the proportion of the sound energy below 1000 Hz of the input sound to all sound energy of the input sound is between 0% and 20%.

8. The hearing aid as claimed in claim 7, wherein A is a value between 0 and 70.

9. The hearing aid as claimed in claim 6, 7 or 8, wherein B is 1.3 to 10,000 times of A.

10. The hearing aid as claimed in claim 6, 7, or 8, wherein the input sound is modified into the modified input sound by means of frequency compression or frequency shifting.

* * * * *